US006142213A

United States Patent [19]

Gallivan et al.

[11] Patent Number: 6,142,213

[45] Date of Patent: Nov. 7, 2000

[54] DUCTED COOLING SYSTEM WITH RADIAL-FLOW FAN

[75] Inventors: William P. Gallivan; Peter A. Kershaw, both of London, Canada

[73] Assignee: Siemens Canada Limited, Mississauga, Canada

[21] Appl. No.: 08/978,406

[22] Filed: Nov. 25, 1997

[51] Int. Cl.[7] ..... F01P 5/02; F01P 7/10; B60H 1/24

[52] U.S. Cl. ..... 165/41; 165/51; 165/122; 165/127; 123/41.49; 180/68.1; 180/68.4; 454/259

[58] Field of Search ..... 165/127, 41, 51, 165/122; 123/41.49, 41.48; 454/259; 180/68.1, 68.4; 415/146

[56] References Cited

U.S. PATENT DOCUMENTS

| | | | |
|---|---|---|---|
| 718,657 | 1/1903 | Renton | 454/259 |
| 1,860,357 | 5/1932 | Gant . | |
| 1,863,554 | 6/1932 | Alberts . | |
| 1,906,533 | 5/1933 | Burke . | |
| 1,966,787 | 7/1934 | Buri | 123/41.49 |
| 2,067,758 | 1/1937 | Flogaus | 123/41.49 |
| 2,169,693 | 8/1939 | Haynes | 165/127 |
| 2,242,495 | 5/1941 | Wolf | 123/41.49 |
| 2,360,386 | 10/1944 | Young | 165/127 |
| 2,503,667 | 4/1950 | Hagen | 257/137 |
| 2,871,677 | 2/1959 | Bradfield | 62/285 |
| 3,236,298 | 2/1966 | Laing | 165/124 |
| 3,696,730 | 10/1972 | Masuda et al. | 98/2.06 |
| 3,733,849 | 5/1973 | Cantagallo et al. | 62/239 |
| 4,126,268 | 11/1978 | Vitale | 236/38 |
| 4,372,409 | 2/1983 | Mazur | 180/54 A |
| 4,376,424 | 3/1983 | Mazur | 123/41.12 |
| 4,417,636 | 11/1983 | Mazur | 180/68 R |
| 4,445,583 | 5/1984 | Mazur | 180/68.1 |
| 4,461,246 | 7/1984 | Clemente | 123/41.49 |
| 4,519,343 | 5/1985 | Hayashi et al. | 123/41.49 |
| 4,821,796 | 4/1989 | Schulz | 165/122 |
| 4,832,116 | 5/1989 | Easton | 165/126 |
| 4,840,221 | 6/1989 | Dumas et al. | 165/41 |
| 4,979,584 | 12/1990 | Charles | 180/68.1 |
| 5,046,554 | 9/1991 | Iwasaki et al. | 165/140 |
| 5,181,554 | 1/1993 | Mita | 165/41 |
| 5,193,609 | 3/1993 | Cowart | 165/42 |
| 5,209,189 | 5/1993 | Weitzenbuerger et al. | 123/41.49 |
| 5,234,051 | 8/1993 | Weizenburger et al. | 165/41 |

(List continued on next page.)

FOREIGN PATENT DOCUMENTS

| | | | |
|---|---|---|---|
| 1138809 | 6/1957 | France | 165/127 |
| 2632166 | 2/1977 | Germany | 165/127 |
| 2903764 | 9/1980 | Germany | 123/41.49 |
| 3112630 | 10/1982 | Germany | 123/41.49 |
| 3407746 | 9/1985 | Germany | 123/41.49 |
| 0163118 | 10/1982 | Japan | 123/41.49 |

(List continued on next page.)

OTHER PUBLICATIONS

ASHRAE Handbook Chapter 3, "Fans" coyright ASHRAE Atlanta, Georgia, 1983.

*Primary Examiner*—John K. Ford

[57] ABSTRACT

A cooling system for a vehicle having a liquid-cooled engine is provided. The cooing system includes a heat exchanger constructed and arranged to be mounted in spaced relation with respect to the engine for cooling the liquid by air directed from a front side of the heat exchanger through a rear side of the heat exchanger. Duct structure is coupled to the rear side of the heat exchanger so as to cover at least a portion of the rear side, and to receive at least a portion of air exiting the rear side of the heat exchanger. The duct structure is mounted with respect to the heat exchanger so that a portion of the duct structure extends beyond bounds of a sidewall of the heat exchanger. At least one radial-flow type fan is mounted in the extending portion of duct structure such that air flowing through the heat exchanger and the duct structure is pulled by the fan so as to exit generally at the sidewall of the heat exchanger. A motor is operatively coupled to the fan to drive the fan.

25 Claims, 2 Drawing Sheets

U.S. PATENT DOCUMENTS

| | | | |
|---|---|---|---|
| 5,443,042 | 8/1995 | Kiefer | 123/41.49 |
| 5,495,909 | 3/1996 | Charles | 180/68.1 |
| 5,588,482 | 12/1996 | Holka | 165/44 |
| 5,660,149 | 8/1997 | Lakerdas et al. | 123/41.49 |
| 5,839,397 | 11/1998 | Funabashi et al. | 123/41.49 |

FOREIGN PATENT DOCUMENTS

| | | | |
|---|---|---|---|
| 0046316 | 3/1984 | Japan | 123/41.49 |
| 0224415 | 12/1984 | Japan | 123/41.49 |
| 0153426 | 7/1986 | Japan | 165/127 |
| 351729 | 7/1931 | United Kingdom | 123/41.48 |
| 1236524 | 6/1971 | United Kingdom | 123/41.49 |

DUCTED COOLING SYSTEM WITH RADIAL-FLOW FAN

FIELD OF THE INVENTION

The present invention relates to an engine cooling system, and more particularly to an efficient engine cooling system including duct structure leading to a radial-flow type fan mounted so as to extend beyond a sidewall of a heat exchanger.

BACKGROUND OF THE INVENTION

Typical vehicle cooling systems include a low-profile axial fan mounted between a vehicle's liquid-cooled engine and a heat exchanger to draw air through the heat exchanger and thus provide cooling of the engine. Axial fans are advantageous since they may be positioned directly behind the radiator, be driven by the engine, and may be made compact. However, a drawback in using axial fans in engine cooling systems is that these types of fans have efficiencies generally between 40% and 60% and are a significant source of noise in the engine compartment.

SUMMARY OF THE INVENTION

It is an object of the present invention to provide a vehicle cooling system to fulfill the need referred to above. In accordance with the principles of the present invention, this object is obtained by providing a cooling system for a vehicle having a liquid-cooled engine. The cooling system includes a heat exchanger constructed and arranged to be mounted in spaced relation with respect to the engine for cooling liquid by air, the air being directed from a front side of the heat exchanger through a rear side of the heat exchanger. Duct structure is coupled to the rear side of the heat exchanger so as to cover at least a portion of the rear side, and to receive air exiting a portion of the rear side of the heat exchanger. The duct structure is mounted with respect to the heat exchanger so that a portion of the duct structure extends beyond bounds of a sidewall of the heat exchanger. At least one radial-flow type fan is mounted in the extending portion of duct structure such that air flowing through the heat exchanger and the duct structure is pulled by the fan so as to exit generally at the sidewall of the heat exchanger. A motor is operatively coupled to the fan to drive the fan.

Another object of the invention is to provide duct structure for a vehicle cooling system having a liquid-cooled engine and a heat exchanger mounted forward of the engine. The duct structure includes an inlet portion constructed and arranged to be coupled to a rear side of a heat exchanger so as to cover at least a portion of the rear side for receiving at least a portion of air exiting the rear side of the heat exchanger. The duct structure is sized to extend generally a width of the heat exchanger so that opposing ends of the duct structure may be located generally at opposing sidewalls of the heat exchanger. Fan may be disposed generally at a top portion, middle portion or bottom portion of duct structure, with central axis of blower wheel/motors either vertical or horizontal. The duct structure is constructed and arranged to receive air flowing into the inlet in a particular direction, and to change the direction of air flow to be generally transverse to the particular direction as air moves generally upwardly toward the fan mounting portion. The duct structure also includes an exhaust communicating with the fan mounting portion to exhaust air from the duct structure.

Other objects, features and characteristics of the present invention, as well as the methods of operation and functions of related elements of the structure, and the combination of the parts and economics of manufacture, will become more apparent upon consideration of the detailed description and appended claims with reference to the accompanying drawings, all of which form a part of this specification.

DETAILED DESCRIPTION OF THE PRESENTLY PREFERRED EXEMPLARY EMBODIMENT

Figure 1:
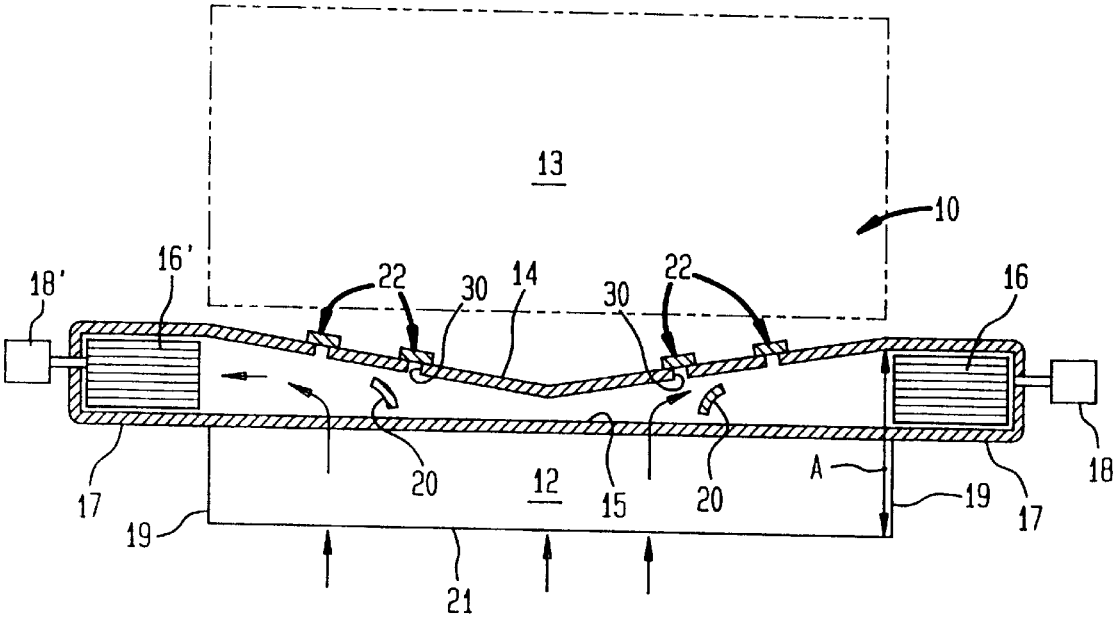
FIG. 1 is a plan view, partially in section, of a ducted cooling system provided in accordance with the principles of the present invention shown mounted adjacent to a heat exchanger.

Referring to the drawings, a vehicle cooling system is shown generally indicated at 10, which embodies the principles of the present invention.

Figure 2:
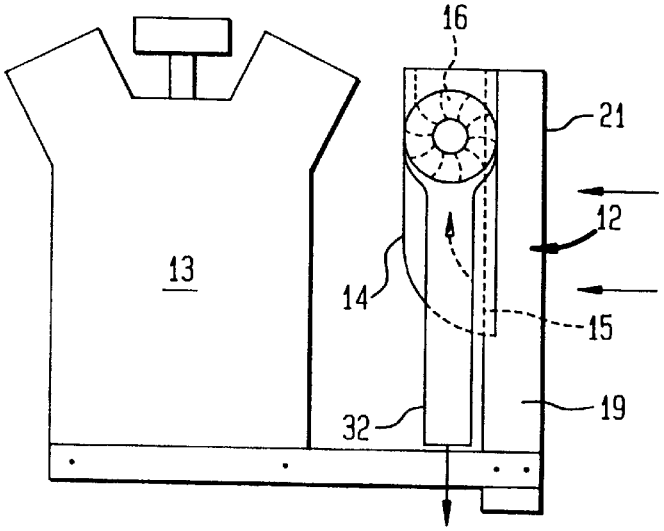
FIG. 2 is a schematic side illustration of the cooling system of FIG. 1 mounted to a heat exchanger forward of an engine, shown with the fan motor removed for clarity of illustration.

In a typical vehicle, a heat exchanger 12 or radiator is conventionally mounted behind a grille and forward of a liquid-cooled engine 13 of the vehicle. In accordance with the invention, the heat exchanger 12 is part of the cooling system 10 which also includes duct structure 14 mounted on the discharge or rear side 15 of the heat exchanger 12. The block outline in FIG. 1 representing the heat exchanger 12 may also include an air-conditioning condenser, charge air cooler, transmission cooler or any other type of heat exchanger. In the illustrated embodiment, the duct structure 14 spans the width of the heat exchanger 12 and has end portions 17 that extend beyond the bounds of sidewalls 19 of the heat exchanger. As best shown in FIG. 2, the duct structure 14 is preferably made of plastic material and covers at least a portion of the rear side 15 of the heat exchanger 12 such that at least a portion of air exiting the heat exchanger 12 is introduced into the duct structure 14. It can be appreciated that the duct structure is sized to cover as much as, or as little of, the rear side 15 of the heat exchanger 12 as needed for the particular cooling application.

The cooling system 10 also includes at least one radial or centrifugal fan 16 and a motor 18 operatively associated with the fan 16 to drive the fan. The fan 16 is mounted in the end or fan-mounting portion 17 of the duct structure generally near a top portion thereof, with the motor being operatively coupled to the fan 16. Thus, the fan 16 and motor 18 are generally disposed at a sidewall 19 of the heat exchanger 12. In the illustrated embodiment, a pair of radial fans 16, 16' and associated motors 18 and 18' are provided at opposing ends of the duct structure 14 and thus, at opposing sides of the heat exchanger 12. It can be appreciated that one motor may be provided to drive both of the fans 16, 16', if desired. Although one motor and one fan may be all that is required to cool a vehicle engine, the second fan 16' may be provided if more cooling capacity is required. The motors 18 and 18' are preferably electric motors operated by the vehicle's electrical system. However, other types of prime movers, such as hydraulic motors, may be used to drive the fans.

As viewed from above and as shown in FIG. 1, the duct structure increases in size as it approaches the fan location for directing air flow to the fan 16. When two fans are provided, the duct structure increases gradually in size in opposite directions from a central portion, toward the fan locations. Further, vanes 20 may be provided in the duct structure to further channel air from the heat exchanger 12 to the inlets of the fans 16, as indicated by the arrows in FIG. 1.

Figure 3:
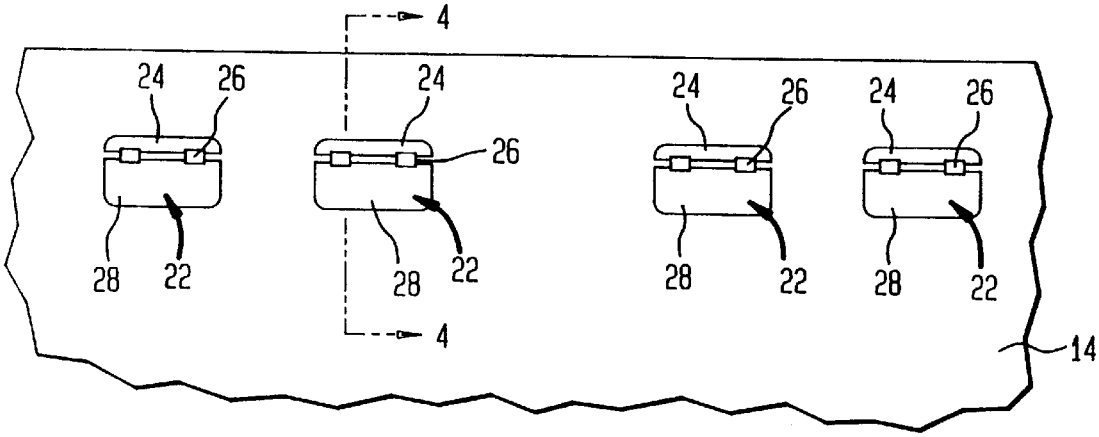
FIG. 3 is a rear view of the duct structure of FIG. 1, showing the air doors.
Figure 4:
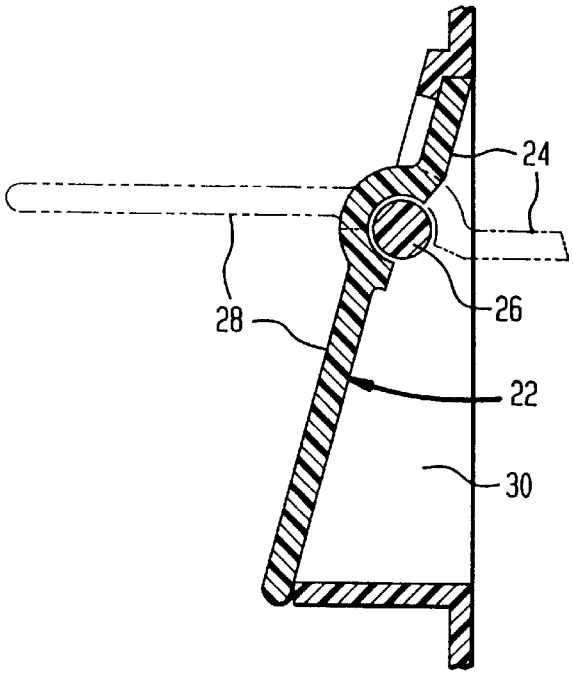
FIG. 4 is an enlarged sectional view taken along the line 4—4 in FIG. 3.

A plurality of air doors, generally indicated at 22, are provided in the duct structure 14 and are of the type disclosed in commonly assigned U.S. patent application Ser. No. 08/711,703, filed on Sep. 6, 1996, the disclosure of which is hereby incorporated into the subject specification by reference. As best shown in FIGS. 3 and 4, each air door 22 has an upper portion 24, a generally central hinge portion 26 and a lower portion 28. The air doors are constructed and arranged to remain closed (i.e sealing associated bores 30) until there is a predetermined threshold air velocity (an air velocity typically corresponding to a designated velocity of the vehicle). At the threshold velocity, the upper and lower portions of each air door will pivot about the associated hinge portion 26 and move to a substantially horizontal, opened position, opening bores 30 in the duct structure 14 to reduce the static pressure drop across the system and increase the total flow rate through the system.

With reference to the air flow arrows in FIGS. 1 and 2, in general, air moving in an initial direction passes from a front side 21 to the rear side 15 of the heat exchanger 12 to the inlet of the duct structure 14 and then changes direction to move generally upwardly and transverse to the initial direction as it moves to the inlet of the fans 16, 16' wherein it is impelled inwardly by the blades of the fans and across the interior of the fans. The air is then impelled outwardly by the blades and downwardly to an exhaust duct 32 located at the sidewalls 19, and away from or out of the engine compartment. Air exhaust duct 32 is located in a position to minimize air recirculation to the inlet of heat exchanger 12 and to take advantage of any low pressure region created by the vehicle aerodynamics. The exhaust duct 32 may be oriented toward any local hot spot in the engine compartment to provide localized cooling.

Since the fans 16 and 16' are mounted generally at the sides of the heat exchanger 12, a fan module design of short axial length (dimension A in FIG. 1 of approximately 150 mm) for a high resistance heat exchanger is possible. The fans 16, 16' and motors 18, 18' are located in an area of the engine compartment that is not considered to be a prime location. Thus, the fans may have a diameter of about 12 inches and a length generally between 6–8 inches. The portion 17 of the duct structure that extends beyond sidewalls 19 may be modified accordingly to accommodate the particular fan size. The fans 16, 16' and motors 18, 18' are sized, however, for the particular cooling requirements of the engine 13.

The location of the fans 16, 16' at the sides of the heat exchanger 12 increases flow resistance, requiring the relatively large duct structure 14. Thus, the fans are selected for high resistance operation and operate at higher efficiency. This will result in higher heat rejecting cooling systems.

The location of the fans 16, 16' at the sidewalls of the heat exchanger 12 may also provide a reduction in noise. To reduce fan noise further, the duct structure 14 may be acoustically treated.

With axial flow fan systems, the fan creates resistance to the air flow during vehicle high speed operation. This requires the fan motor to be energized to reduce flow resistance. With the ducted cooling system of the invention, the fan or fans are out of the flow stream and do not provide a resistance to the ram air, and the motor does not have to be energized, which results in a power savings.

It can be seen that the invention provides a duct cooling system employing duct structure and an efficient, radial-flow type fan that is selected for high flow resistance and that is oriented, together with its motor, at a non-prime engine compartment location.

While the invention has been described in connection with what is presently considered to be the most practical and preferred embodiment, it is understood that the invention is not limited to the disclosed embodiment, but, on the contrary, is intended to cover various modifications and equivalent arrangements included within the spirit and scope of the appended claims.

What is claimed is:

1. A cooling system for a vehicle having a liquid-cooled engine, the system comprising:

a heat exchanger constructed and arranged to be mounted in spaced relation with respect to the engine for cooling liquid by air, the air being directed from a front side of the heat exchanger through a rear side of the heat exchanger, duct structure comprising:

an inlet portion coupled to the rear side of the heat exchanger so as to cover at least a portion of the rear side for receiving at least a portion of air exiting the rear side of the heat exchanger, said duct structure being sized to extend generally a width of the heat exchanger so that opposing ends of the duct structure are located generally at opposing sidewalls of the heat exchanger, a fan mounting portion disposed generally at a top portion of said duct structure and located at each end thereof so as to extend beyond a sidewall of the heat exchanger and generally adjacent to said sidewall, said duct structure being constructed and arranged to receive air flowing into said inlet portion in an initial direction, and to change the direction of air flow to be generally transverse to said initial direction as said air moves generally upwardly and toward said fan mounting portion, said duct structure tapering outwardly toward said fan mounting portion such that said fan mounting portion has the widest cross-sectional area of the duct structure, and;

an exhaust passage communicating with each said fan mounting portion to exhaust air downwardly from said duct structure to an associated exhaust duct located at a respective side wall of the heat exchanger, a centrifugal fan mounted in each said fan mounting portion of duct structure such that air flowing through the heat exchanger and said duct structure is pulled by each said fan, and a motor operatively coupled to each said fan to drive each fan.

2. The cooling system according to claim 1, wherein said duct structure increases in size from a first size at a central portion to a larger size at each of the end portions thereof.

3. The cooling system according to claim 1, wherein said motor is an electric motor constructed and arranged to be operated by a vehicle's electric system.

4. The cooling system according to claim 1, wherein said motor is a hydraulic motor.

5. The cooling system according to claim 1, further including vanes disposed in said duct structure for directing air to each fan.

6. The cooling system according to claim 1, wherein said duct structure has a plurality of bores therein and includes an air door structure associated with each said bore, said air door structure being constructed and arranged to remain closed, closing said bores until exposed to a predetermined threshold air velocity, whereby said air door structures move to an opened condition, opening said bores.

7. The cooling system according to claim 6, wherein each of said air door structures comprises an upper portion, a lower portion and a hinge portion coupling the upper and lower portions, and when exposed to a threshold velocity, the upper and lower portions of each air door are constructed and arranged to pivot about the associated hinge portion and move to substantially horizontal opened position, opening an associated bore in the duct structure.

8. The cooling system according to claim 1, wherein a maximum axial length of said heat exchanger and said duct structure coupled thereto is approximately 150 mm.

9. A method of cooling a liquid-cooled engine of a vehicle comprising:

providing a heat exchanger mounted in spaced relation with respect to the engine for cooling liquid by air, the air being directed from a front side of the heat exchanger through a rear side of the heat exchanger, providing duct structure comprising:

an inlet portion coupled to the rear side of the heat exchanger so as to cover at least a portion of the rear side for receiving at least a portion of air exiting the rear side of the heat exchanger, said duct structure being sized to extend generally a width of the heat exchanger so that opposing ends of the duct structure are located generally at opposing sidewalls of the heat exchanger, a fan mounting portion disposed generally at a top portion of said duct structure and located at each end thereof so as to extend beyond a sidewall of the heat exchanger and generally adjacent to said sidewall said duct structure being constructed and arranged to receive air flowing into said inlet portion in an initial direction, and to change the direction of air flow to be generally transverse to said initial direction as said air moves generally upwardly and toward said fan mounting portion, said duct structure tapering outwardly toward said fan mounting portion such that said fan mounting portion has the widest cross-sectional area of the duct structure, and an exhaust passage communicating with each said fan mounting portion to exhaust air downwardly from said duct structure to an associated exhaust duct located at a respective sidewall of the heat exchanger, providing a centrifugal fan mounted in each of said fan mounting portion of duct structure such that air flowing through the heat exchanger and said duct structure is pulled by said fans, and employing at least one motor to drive said fans.

10. The method according to claim 9, wherein a motor is operatively coupled to each said fan.

11. The method according to claim 9, wherein said duct structure is provided so as to increases in size from a first size at a central portion to a larger size at each of the end portions thereof.

12. The method according to claim 9, wherein said motor is an electric motor operated by a vehicle electrical system.

13. The method according to claim 9, further providing vanes disposed in said duct structure for directing air to each fan.

14. The method according to claim 9, wherein said duct structure has a plurality of bores therein and includes an air door structure associated with each said bore, said air door structure remaining closed, closing said bores until exposed to a predetermined threshold air velocity, whereby said air door structures move to an opened condition, opening said bores.

15. The method according to claim 14, wherein each of said air door structures comprises an upper portion, a lower portion and a hinge portion coupling the upper and lower portions, and when exposed to a threshold velocity, the upper and lower portions of each air door pivot about the associated hinge portion and move to substantially horizontal, opened position, opening an associated bore in the duct structure.

16. The method according to claim 9, wherein a total maximum length of said heat exchanger and said duct structure coupled thereto is approximately 150 mm.

17. A cooling system for a vehicle having a liquid-cooled engine, the system comprising:

a heat exchanger constructed and arranged to be mounted in spaced relation with respect to the engine for cooling liquid by air, the air being directed from a front side of the heat exchanger through a rear side of the heat exchanger, duct structure comprising:

an inlet portion coupled to the rear side of the heat exchanger so as to cover at least a portion of the rear side for receiving at least a portion of air exiting the rear side of the heat exchanger, said duct structure being sized to extend generally a width of the heat exchanger so that opposing ends of the duct structure are located generally at opposing sidewalls of the heat exchanger, a fan mounting portion disposed generally at a top portion of said duct structure and located at each end thereof so as to extend beyond a sidewall of the heat exchanger and generally adjacent to said sidewall, said duct structure being constructed and arranged to receive air flowing into said inlet portion in an initial direction, and to change the direction of air flow to be generally transverse to said initial direction as said air moves generally upwardly and toward said fan mounting portion, said duct structure tapering outwardly toward said fan mounting portion such that said fan mounting portion has the widest cross-sectional area of the duct structure, and an exhaust passage communicating with each said fan mounting portion to exhaust air downwardly from said duct structure to an associated exhaust duct located at a respective sidewall of the heat exchanger, a centrifugal fan mounted in each of said fan mounting portion of duct structure such that air flowing through the heat exchanger and said duct structure is pulled by said fans, at least one motor operatively coupled to said fans to drive said fans; and wherein said duct structure has a plurality of bores therein and includes an air door structure associated with each said bore, said air door structures being constructed and arranged to remain closed, closing said bores until exposed to a predetermined threshold air velocity whereby said air door structures move to an opened condition, opening said bores.

18. The cooling system according to claim 17, wherein each of said air door structures comprises an upper portion, a lower portion and a hinge portion coupling the upper and lower portions, and when exposed to a threshold velocity, the upper and lower portions of each air door are constructed and arranged to pivot about the associated hinge portion and move to substantially horizontal, opened position, opening an associated bore in the duct structure.

19. The cooling system according to claim 17, wherein a maximum axial length of said heat exchanger and said duct structure coupled thereto is approximately 150 mm.

20. Duct structure for a vehicle cooling system having a liquid-cooled engine and a heat exchanger mounted forward of said engine, said duct structure comprising:

an inlet portion constructed and arranged to be coupled to a rear side of a heat exchanger so as to cover at least a portion of the rear side for receiving at least a portion of air exiting the rear side of the heat exchanger, said duct structure being sized to extend generally a width of the heat exchanger so that opposing ends of the duct structure may be located generally at opposing sidewalls of the heat exchanger, a fan mounting portion disposed generally at a top portion of said duct structure and located at at least one end thereof so as to extend beyond a sidewall of the heat exchanger and generally adjacent to said sidewall, said duct structure being constructed and arranged to receive air flowing into said inlet in an initial direction, and to change the direction of air flow to be generally transverse to said initial direction as said air moves generally upwardly and toward said fan mounting portion, said duct structure tapering outwardly toward said fan mounting portion such that said fan mounting portion has the widest cross-sectional area of the duct structure, and an exhaust passage communicating with said fan mounting portion to exhaust air downwardly from said duct structure to an exhaust duct located at the sidewall of the heat exchanger.

21. The cooling system according to claim 20, further including vanes disposed in said duct structure for directing air toward said fan mounting portion.

22. The duct structure according to claim 20 in combination with a centrifugal fan mounted in said fan mounting portion for moving air from said inlet to said exhaust.

23. The duct structure according to claim 20 including a fan mounting portion at the opposing ends of the duct structure with each fan mounting portion being constructed and arranged to extend beyond bounds of an associated sidewall of a heat exchanger, the duct structure including an exhaust associated with each fan mounting portion, said duct structure gradually increasing in size from a first dimension at a central portion thereof to a larger dimension at each of the fan mounting portions thereof.

24. The duct structure according to claim 23 in combination with a centrifugal fan mounted in each of said fan mounting portions for moving air from said inlet to said exhausts.

25. The duct structure according to claim 23, further including a plurality of bores in a rear portion thereof generally opposite said inlet and an air door structure associated with each said bore, said air door structures being constructed and arranged to remain closed, closing said bores until exposed to a predetermined threshold air velocity whereby said air door structures move to an opened condition, opening said bores.

* * * * *